United States Patent [19]

Taylor

[11] 4,132,409

[45] Jan. 2, 1979

[54] POLICE BATON WITH ROTATABLE CROSSHANDLE

[76] Inventor: Anthony E. Taylor, P.O. Box D, La Verne, Calif. 91750

[21] Appl. No.: 807,964

[22] Filed: Jun. 20, 1977

[51] Int. Cl.[2] ..... F41B 15/02

[52] U.S. Cl. ..... 273/84 R

[58] Field of Search ..... 273/67 R, 73 J, 75, 273/81 R, 81 C, 81 D, 81.2, 81.3, 84 R, 162 R, 193 R; 272/67, 75; D34/5 BC; 46/47, 51; D22/99; 84/477 B; 135/67, 72, 76; 15/143 R, 144 R, 144 A; 74/551.8, 551.9; 16/110 R, 114 R, DIG. 12, 24

[56] References Cited

U.S. PATENT DOCUMENTS

| | | | |
|---|---|---|---|
| D. 230,150 | 1/1974 | Anderson | 273/84 R X |
| 1,920,169 | 8/1933 | Briggs | 273/81.3 X |
| 2,225,839 | 12/1940 | Moore | 273/81 C |
| 2,988,949 | 6/1961 | Rohmann | 84/477 B |
| 3,636,811 | 1/1972 | Bailey | 84/477 B |
| 3,804,413 | 4/1974 | Hrivnak | 273/81 C |
| 3,962,949 | 6/1976 | Trowbridge | 84/477 B |

OTHER PUBLICATIONS

"Black Belt"; Jul. 1969; pp. 14 and 15.

*Primary Examiner*—Richard J. Apley
*Attorney, Agent, or Firm*—Christie, Parker & Hale

[57] ABSTRACT

A police baton or billy having a short crosshandle extending therefrom to enable a high-speed sweeping motion and other defensive maneuvers of the baton. The crosshandle has a rotatable sleeve or ring which is gripped by part of the hand when the baton is spun about the crosshandle axis. A stationary portion of the handle adjacent the sleeve is gripped to decelerate the baton at the end of the spinning or sweeping motion.

7 Claims, 3 Drawing Figures

POLICE BATON WITH ROTATABLE CROSSHANDLE

BACKGROUND OF THE INVENTION

A conventional police baton or billy is a club which is typically about two-feet long and about one to one and one-fourth inch in diameter, and which is usually made of wood, hard rubber, or a plastic material. The baton is gripped at one end, and is used in a sweeping or jabbing motion to fend off an assailant. Police officers are also taught other baton maneuvers which assist in disarming and apprehending a suspect.

A modified baton incorporating a short stationary crosshandle (positioned about six inches from the handgrip end, and extending perpendicularly from the baton) is believed to have been first used by police officers on Okinawa Island in the North Pacific Ocean. It is understood that the crosshandle is there referred to as a "Yawara" handle. One style of a weapon of this type is shown in U.S. Pat. No. Des. 230,150 titled "Police Club or Similar Article".

The modified baton is gripped by the crosshandle which extends upwardly from the baton when swinging the baton in a generally horizontal plane. During this swinging or sweeping motion, the grip of the hand is loosened sufficiently to permit the crosshandle to rotate within the hand. The baton thus achieves significantly greater velocity during a swinging stroke, because the rotational speed is added to the speed of the swinging motion. The crosshandle baton is considered by many police departments to be a more effective defensive weapon than a conventional straight baton, and, with proper training, it can provide real assistance to an officer in a difficult defensive or arrest situation.

A weakness of known crosshandle batons is that considerable training is required to acquire skill in loosening and tightening the grip of the hand to enable the spinning motion, and to brake this motion at the end of a sweeping stroke. The spinning handle also tends to work downwardly out of the officer's hand after a stroke or two, and must be repeatedly regripped during use to insure that the weapon is properly moved and retained. These drawbacks have tended to limit use of the crosshandle baton, and to discourage the investment in training which is required to insure effective and safe use of the weapon.

I have found that these weaknesses in known crosshandle batons are overcome by providing a rotatable sleeve on the crosshandle. The officer's grip on the stationary portion of the handle is relaxed to permit baton spin during a sweeping stroke, but a tight grip is constantly maintained on the rotatable sleeve. The baton achieves a higher spin velocity with the rotatable sleeve, and is easier for the officer to control throughout a swinging stroke. The tendency of the crosshandle to work out of the hand is also overcome by the rotatable sleeve which provides a secure grip and eliminates need for constant regripping during repeated swings of the baton.

SUMMARY OF THE INVENTION

Briefly stated, the baton of this invention comprises a police nightstick or club having a crosshandle rigidly secured to and extending perpendicularly therefrom. An outer part of the handle defines a gripping surface which is stationary with respect to the club. A sleeve is rotatably mounted on the handle between the club and gripping surface, and the sleeve effectively forms a rotatable continuation of the stationary gripping surface. A mounting saddle is preferably positioned between the club and sleeve, and the mounting saddle and handle are pinned together to insure a slight axial freedom of the sleeve to provide free rotation of the sleeve on the handle. The crosshandle components are preferably clamped to the club by a bolt mounted on the club and threaded into the handle.

DESCRIPTION OF THE PREFERRED EMBODIMENT

Figure 2:
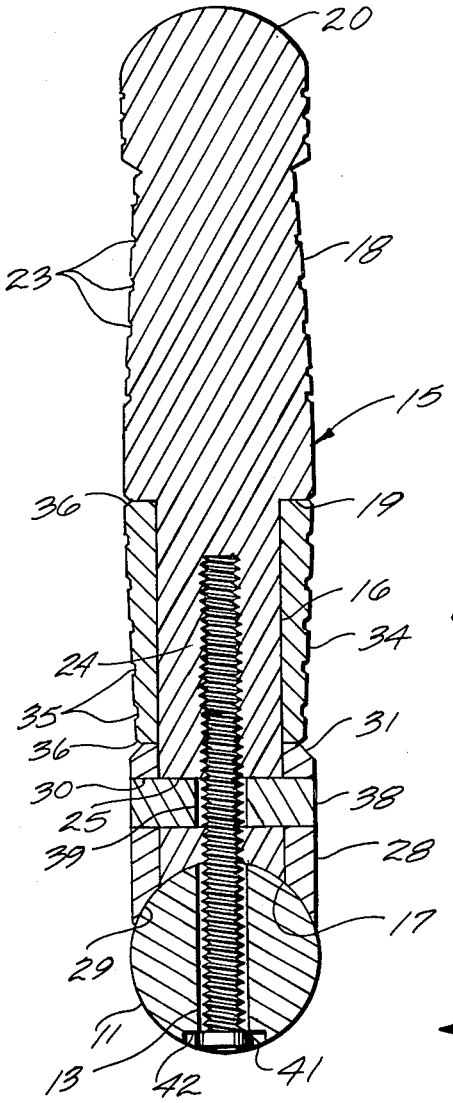
FIG. 2 is a section on line 2—2 of FIG. 1.
Figure 1:
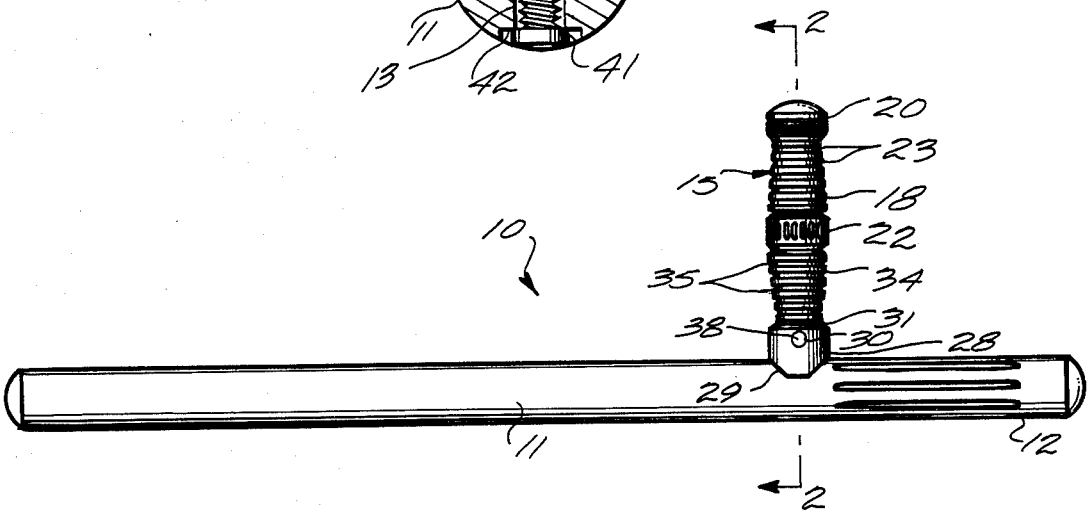
FIG. 1 is an elevation of a police baton according to the invention.
Figure 3:
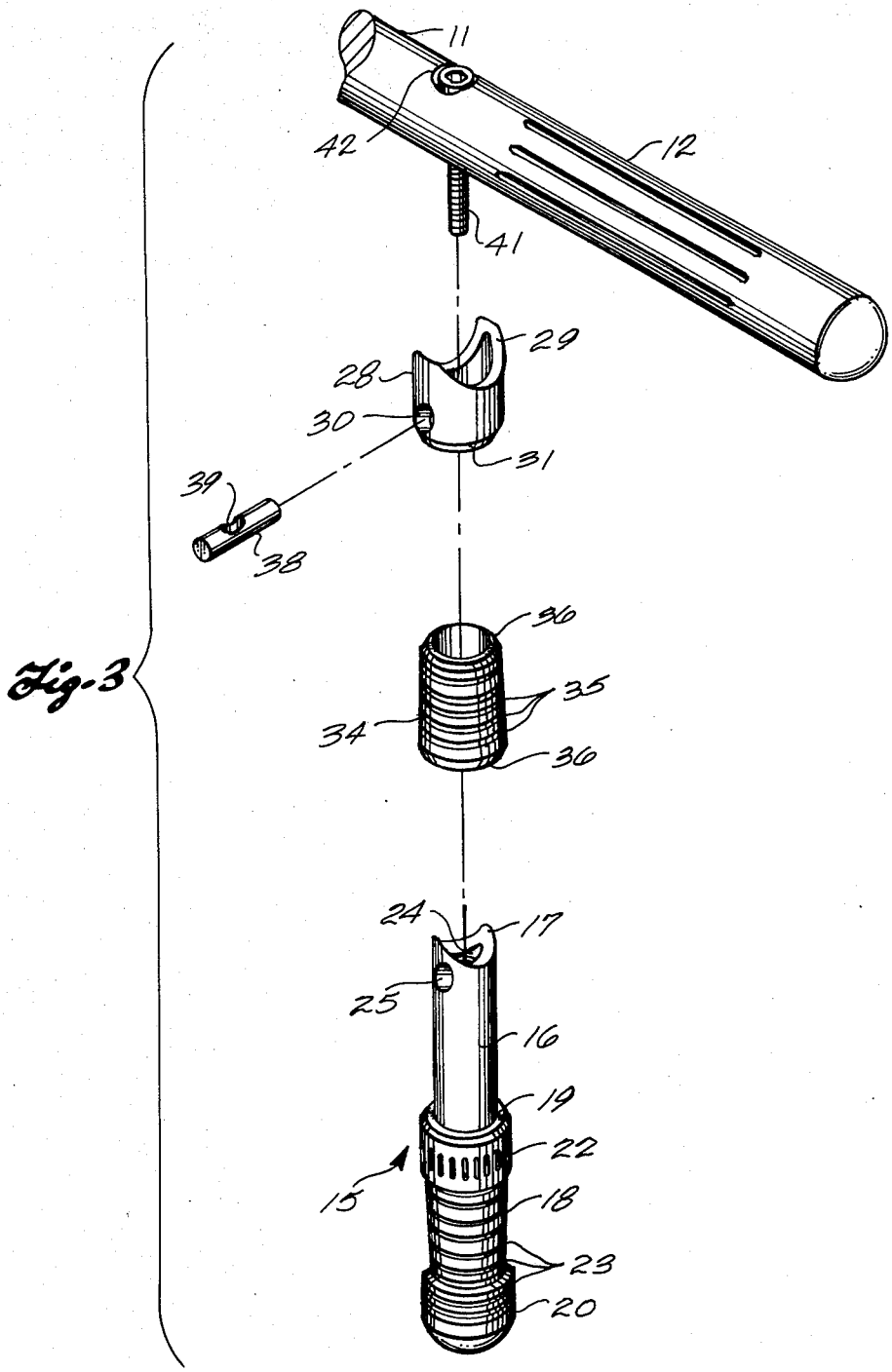
FIG. 3 is an exploded view of parts forming a crosshandle for the baton.

A crosshandle baton assembly 10 according to the invention is shown in FIG. 1. The assembly includes an elongated club 11 which may be a conventional police baton as used in law-enforcement work. Preferably, the club is about 24 inches in length and 1¼ inch in diameter, and is made of wood or a plastic material such as glass-filled polycarbonate plastic. As shown in FIG. 2, the club has a conventional circular cross section, and includes a fluted handgrip portion 12 adjacent one end. A bore 13 extends diametrically through the club adjacent the inner end of handgrip portion 12.

A crosshandle for the baton assembly includes an elongated handle 15 having a cylindrical shank 16. An end 17 of the shank is concave or saddle shaped to mate with the cylindrical outer surface of the club when the longitudinal axes of the handle and club are perpendicularly positioned as shown in FIG. 2. A handgrip portion 18 of the handle terminates in a shoulder 19 at the end of the shank. An enlarged knob 20 is formed at the end of the handgrip portion to resist any tendency of the handle to slip downwardly in the user's hand during use of the baton assembly.

Preferably, a part of the handgrip portion immediately adjacent shoulder 19 includes axially extending depressions or flutes 22 to provide an improved grip for braking spinning motion of the baton assembly at the end of a sweeping stroke. The balance of handgrip portion 18 is formed with circumferentially extending grooves 23 to resist slippage of the handle within the user's hand. An axially extending threaded opening 24 extends from end 17 into shank 16. An unthreaded bore 25 extends diametrically through the shank and is spaced slightly from end 17 as best seen in FIG. 2.

A hollow mounting saddle 28 makes a slip fit over shank 16, and has a concave or saddle-shaped end 29 which continues the curvature of shank end 17 to fit smoothly against the outer surface of the club. An unthreaded bore 30 extends diametrically through the mounting saddle to be in alignment with bore 25 in the handgrip shank when the parts are assembled as shown in FIG. 2. The end of the mounting saddle which faces shoulder 19 includes a beveled surface 31.

A hollow rotatable sleeve 34 makes a slip fit over shank 16 of the handle. The outer surface of the sleeve is formed with circumferential grooves 35 for an improved gripping surface. The ends of the sleeve include beveled surfaces 36.

The parts are assembled by slipping rotatable sleeve 34 over handle shank 16 until the sleeve abuts shoulder 19. Mounting saddle 28 is then slipped over the end of the handle shank to abut the rotatable sleeve. The mounting saddle is rotated to position bore 30 in alignment with bore 25 in the shank, and a locking pin 38 is slipped into the aligned bores. Pin 38 has a diametrically extending central clearance bore 39 therethrough.

The assembled parts are then positioned against club 11 in the position shown in FIG. 2, and a retaining bolt 41 is slipped through bore 13 in the club and threaded into opening 24 in the handle shank through clearance bore 39 in the locking pin. Preferably, a recess 42 is formed in the club around bore 13 to receive the head of bolt 41. The bolt is tightened to secure the handle and mounting saddle rigidly to the club.

The length of rotatable sleeve 34 is selected to provide a slight axial clearance between the end of the mounting saddle and shoulder 19 of the handle. This clearance insures that the sleeve is freely rotatable on the handle shank after bolt 41 is tightened. As best seen in FIG. 1, preferably both handgrip portion 18 and rotatable sleeve 34 are slightly tapered as they extend away from flutes 22 to provide a comfortable grip for the user's hand.

Preferably, the handle, mounting saddle and rotatable sleeve are machined from a lightweight metal such as aluminum, and the outer surfaces of the parts are finished with a black-anodized treatment. Metal is a preferred material for these parts to insure ruggedness and smooth rotation of sleeve 34, but the parts may also be cast from plastic materials. If plastic is used, it is preferable to retain metal for the material of pin 38, and to thread pin bore 39 to receive bolt 41 so a strong metal-to-metal connection is made.

An overall length of about 6 inches (measured from the centerline of club 11) is satisfactory for the crosshandle, and the largest outside diameters of the mounting saddle and the fluted and knob portions of the handle are preferably about 1¼ inches in diameter. The tapered portions of the handle handgrip portion and rotatable sleeve preferably reduce to a minimum diameter of about 1 inch, and sleeve 34 is about 1½ inches long.

In use, the crosshandle is gripped with the thumb and first and second fingers positioned around stationary handgrip portion 18. The third and fourth fingers are positioned around rotatable sleeve 34. When the baton assembly is moved in a sweeping motion, the grip on the stationary handgrip portion is relaxed, while the third and fourth fingers maintain a tight grip on rotatable sleeve 34. This permits the club to spin with respect to the handle during the sweeping motion, adding substantially to the overall club velocity. The crosshandle, however, remains securely positioned in the user's hand due to the firm grip which can be maintained on the rotatable sleeve.

At the end of a sweeping motion of the club, the spinning motion is braked by tightening the grip on the stationary handgrip portion of the handle. The relaxation and tightening of the user's grip on the stationary part of the handle is a skill which is readily acquired after a brief period of practice. Beveled surfaces 36 at the ends of the rotatable sleeve, and the mating beveled surfaces on the handle and mounting saddle form a pair of V-shaped grooves at opposite ends of the rotatable sleeve to prevent pinching of the user's fingers as the handle rotates with respect to the sleeve during a sweeping and spinning motion of the club.

The crosshandle assembly can be added to any standard police baton, and is not restricted to any particular style of club. The only modification required to a standard baton is the forming of a recessed bore to receive bolt 41.

Should cleaning be necessary, the crosshandle assembly is readily dismantled by releasing bolt 41, and the bearing surfaces of the rotatable sleeve are then wiped clean. Pin 38 assures that the parts will be reassembled in correct alignment, and also provides the proper slight axial clearance for the rotatable sleeve without regard to the extent of tightening of the retaining bolt. Other types of retaining arrangements can be used for the rotatable sleeve, but the disclosed configuration is preferred because it is simple, reliable, and inexpensive to produce.

There has been described an improved crosshandle baton which uses a rotatable sleeve to provide improved control and higher velocity during a sweeping and spinning motion of the baton. Novices can learn use of the improved baton in a short period of time, and it is unnecessary to develop a calloused gripping hand to withstand the spinning motion of prior-art batons with non-rotatable crosshandles. The rotatable sleeve is a significant improvement over known designs in that training time is reduced, and the weapon performs more effectively during defensive maneuvers used by a police officer.

What is claimed is:

1. A police baton, comprising:

an elongated club having a longitudinal axis; and an elongated crosshandle secured to the club about midway between an end and the middle of the club, the crosshandle having a longitudinal axis which is substantially perpendicular to the club axis, the crosshandle further having a gripping surface, at least a portion of the gripping surface being rotatable with respect to the club, a stationary portion of the gripping surface being of sufficient axial length to enable gripping thereof by several fingers of the user's hand for braking of club rotation.

2. The baton defined in claim 1 wherein the stationary portion of the crosshandle surface is adjacent the rotatable portion, and the rotatable portion is positioned between the stationary portion and the club.

3. A police baton, comprising:

an elongated club;

a handle extending substantially perpendicularly from the club and having an end configured to fit against the club, the handle having a stationary gripping surface and a cylindrical shank portion adjacent the gripping surface, the stationary gripping surface being of sufficient axial length to enable gripping thereof by several fingers of the user's hand for braking of club rotation;

a sleeve rotatably positioned on the shank portion adjacent the stationary gripping surface, the sleeve being rotatable about a fixed axis which is substantially perpendicular to the club; and means for rigidly securing the handle to the club.

4. The baton defined in claim 3, and further comprising a hollow mounting saddle fitted on the shank portion between the rotatable sleeve and the club, the saddle having an end configured to fit against the outer surface of the club.

5. The baton defined in claim 4 wherein the ends of the rotatable sleeve are beveled, and wherein a portion of the stationary gripping surface adjacent the sleeve is formed with axially extending depressions.

6. The baton defined in claim 5 wherein the shank portion has an axially extending threaded opening, wherein the fastening means comprises a bolt fitted through the club and extending into engagement with the shank portion in the threaded opening, and further comprising a locking pin extending diametrically through the mounting saddle and shank portion, the pin having a central opening therethrough to receive the bolt.

7. A crosshandle attachment for a police baton, comprising a handle having a saddle-shaped concave end for fitting against the baton, the handle having a stationary gripping surface and a cylindrical shank between the gripping surface and the concave end; a sleeve rotatably mounted on the shank, the sleeve having an outer surface which defines a gripping surface which is adjacent and movable with respect to the stationary gripping surface; and means for rigidly securing the handle to the baton.

* * * * *